US009752403B1

(12) United States Patent
Frey

(10) Patent No.: US 9,752,403 B1
(45) Date of Patent: Sep. 5, 2017

(54) WELL REMEDIATION METHOD AND APPARATUS

(71) Applicant: Robert J. Frey, Gretna, NE (US)

(72) Inventor: Robert J. Frey, Gretna, NE (US)

( * ) Notice: Subject to any disclaimer, the term of this patent is extended or adjusted under 35 U.S.C. 154(b) by 382 days.

(21) Appl. No.: 14/575,324

(22) Filed: Dec. 18, 2014

Related U.S. Application Data

(60) Provisional application No. 61/917,567, filed on Dec. 18, 2013.

(51) Int. Cl.

| | |
|---|---|
| ***E21B 29/00*** | (2006.01) |
| ***E21B 33/12*** | (2006.01) |
| ***E21B 33/127*** | (2006.01) |
| ***E21B 37/02*** | (2006.01) |
| ***E21B 33/03*** | (2006.01) |

(52) U.S. Cl.
CPC ..... *E21B 29/005* (2013.01); *E21B 33/03* (2013.01); *E21B 33/1204* (2013.01); *E21B 33/127* (2013.01); *E21B 37/02* (2013.01)

(58) Field of Classification Search
CPC .... E21B 29/002; E21B 29/005; E21B 29/007; B23D 21/14; B23D 45/128; B23D 21/04; B23D 21/08; Y10T 82/16639; Y10T 409/304424; Y10T 83/0596; Y10T 83/384
See application file for complete search history.

(56) References Cited

U.S. PATENT DOCUMENTS

| | | | | |
|---|---|---|---|---|
| 3,293,963 | A * | 12/1966 | Carroll | B23D 21/14 82/128 |
| 4,389,765 | A * | 6/1983 | Thompson, Jr. | B23D 21/14 166/55.8 |
| 2009/0250220 | A1* | 10/2009 | Stamoulis | E21B 29/08 166/298 |
| 2009/0294127 | A1* | 12/2009 | Krueger | E21B 29/005 166/298 |
| 2011/0290091 | A1* | 12/2011 | Clark, II | E02D 9/005 83/54 |
| 2012/0305249 | A1* | 12/2012 | Connell | E21B 29/005 166/285 |
| 2014/0014381 | A1* | 1/2014 | Anda | B23C 3/02 173/31 |
| 2014/0311741 | A1* | 10/2014 | Tunget | E21B 23/14 166/285 |

* cited by examiner

*Primary Examiner* — Kipp Wallace
(74) *Attorney, Agent, or Firm* — Suiter Swantz pc llo

(57) ABSTRACT

An apparatus for remediating water wells comprises a plurality of retractable cutting blades suitable for cutting openings in a well casing. The retractable cutting blades and corresponding drive mechanism are organized to be lowered through a well casing. At certain depths, the retractable blades are extended to cut openings in the well casing. The apparatus also includes inflatable retention elements both above and below the retractable blades to create a fluid seal within the well casing. A solidifying, waterproof slurry is injected to flow through the openings via a slurry delivery mechanism, and thereby create a waterproof barrier outside the well casing at the level of a waterproof confining soil layer.

5 Claims, 11 Drawing Sheets

WELL REMEDIATION METHOD AND APPARATUS

PRIORITY

The present application claims the benefit under 35 U.S.C. §119(e) of U.S. Provisional Application Ser. No. 61/917,567, filed Dec. 18, 2013, which is incorporated herein by reference.

FIELD OF THE INVENTION

The present invention is directed generally toward water wells, and more particularly to water well remediation.

BACKGROUND OF THE INVENTION

Water wells are produced by drilling a borehole from the surface to an appropriate depth of a water bearing layer. Generally, the borehole must traverse a waterproof confining layer. When the confining layer is penetrated, fluids such as chemical contaminants can flow from the surface to the water bearing layer. When a well pipe casing is installed in the borehole, the well casing generally does not fill the entire borehole. The space between the periphery of the well casing and the wall of the borehole is generally filled with a non-waterproof aggregate. Therefore, most existing water wells, including those on farms where fertilizer and pesticide use is common, allow fluids to flow between the wall of the borehole and the well casing, past the penetrated confining layer, into the water bearing layer.

Even when water wells are abandoned, the process for abandoning and sealing a water well does not remedy the gap in the confining layer between the borehole wall and the well casing. Generally an abandoned water well is sealed by filling the well casing with bentonite and capping the well. However, contaminant fluids can percolate through soil down to the confining layer and flow laterally until reaching the point where the confining layer was penetrated by the borehole. The current process of sealing a water well therefore permits contaminants to flow into the water bearing layer, where they may be taken up by other, active wells.

Consequently, it would be advantageous if an apparatus existed that is suitable for remediating water wells and permanently sealing water wells that prevents contaminants from entering the water supply.

SUMMARY OF THE INVENTION

Accordingly, the present invention is directed to a novel method and apparatus for remediating water wells and permanently sealing water wells that prevents contaminants from entering the water supply.

In at least one embodiment of the present invention, an apparatus comprises a plurality of retractable cutting blades suitable for cutting openings through a water well casing. The retractable cutting blades and corresponding drive mechanism are organized to be lowered through a water well casing. At certain depths, the retractable blades are extended to cut openings in the casing. The apparatus also includes inflatable retention elements both above and below the retractable blades to create a fluid seal within the casing. A slurry is then injected to flow through the grooves via a delivery mechanism.

In another embodiment of the present invention, a method for remediating water wells includes identifying a well depth corresponding to a waterproof confining soil layer. Openings are cut into the well casing, from inside the well casing, to allow access to the surrounding soil. An enclosed segment is created by inflating upper and lower air bags relative to the openings in the casing, and a fluid is pumped into the enclosed segment such that the fluid flows out the openings into the space between the borehole wall and the casing. The fluid then partially solidifies. Once the fluid is partially solidified, the air bags are partially deflated such that they no longer create a frictional seal with the casing, but are rigid enough to allow the partially solidified fluid plug in the casing to be removed.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
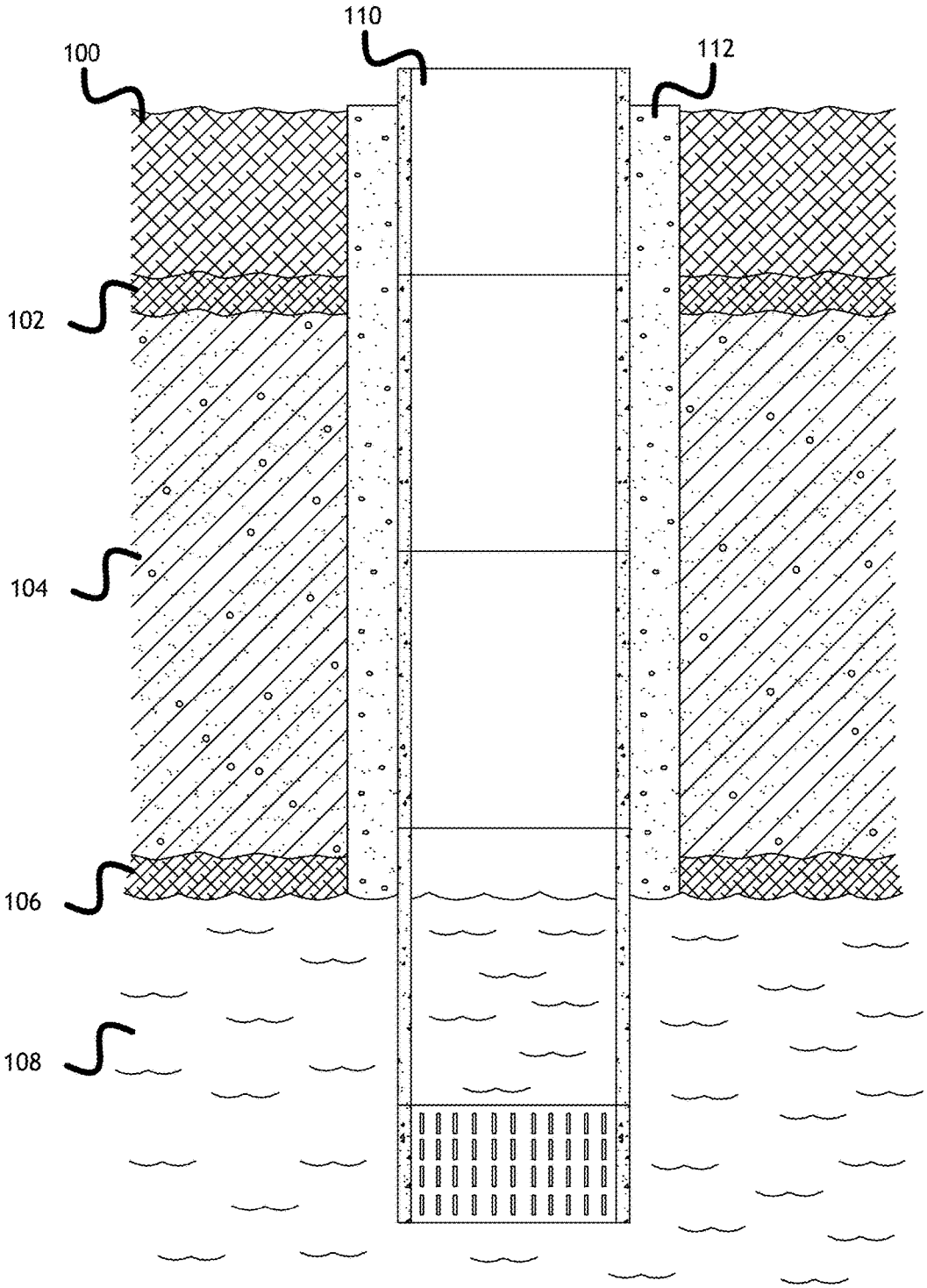
FIG. 1 shows a cross-sectional environmental view of a water well.

Referring to FIG. 1, a cross-sectional environmental view of a water well is shown. Where water wells are drilled, the ground is generally composed of a plurality of distinct layers such as a topsoil layer 100, a semi-confining layer 102, a sub-soil layer 104 and a confining layer 106; all above a potable water bearing layer 108. In undisturbed soil, surface water can penetrate the topsoil layer 100, the semi-confining layer 102 and the sub-soil layer 104, but cannot penetrate the confining layer 106.

A water well is produced by drilling a borehole from the surface to the potable water bearing layer 108 and inserting a casing 110 into the borehole. Generally the casing 110 comprises a plurality of pipe segments joined together to reach a desirable depth. The casing 110 is generally a smaller diameter than the borehole. The space between the wall of the borehole and the casing 110 is filled with some permeable aggregate material 112.

Once the casing 110 and aggregate material 112 are in place, surface water may percolate from the surface, or any of the water permeable layers above the confining layer 106, through the aggregate material 112 into the potable water bearing layer 108. In some cases, surface water and water from any of the water permeable layers may include chemicals and contaminants that are undesirable in the potable water bearing layer 108.

Figure 2:
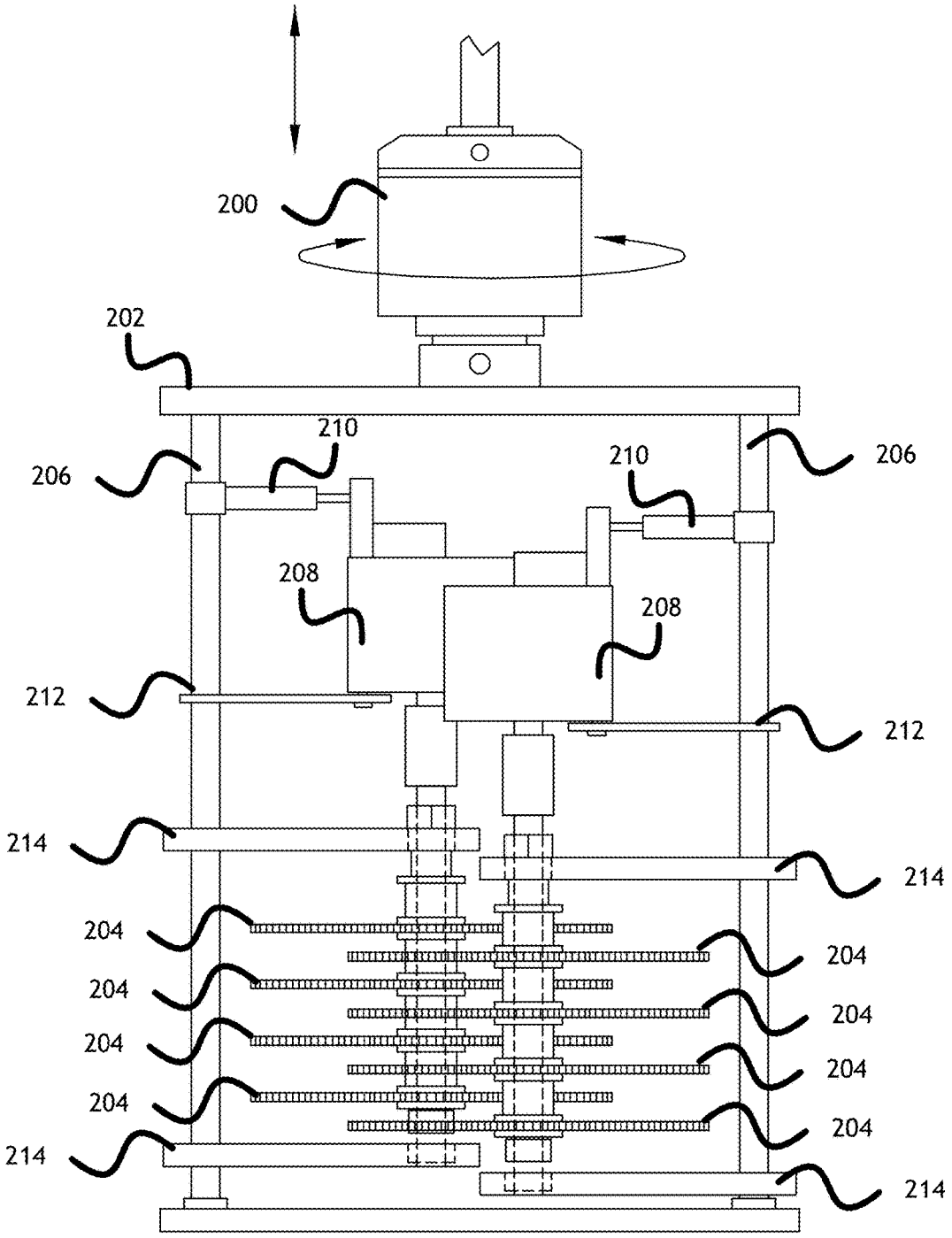
FIG. 2 shows a side view of one embodiment of the present invention.

Referring to FIG. 2, a side view of one embodiment of the present invention is shown. In at least one embodiment, an apparatus includes a plurality of cutting blades 204 configured to cut openings into a water-well casing from inside the casing. The plurality of cutting blades 204 may be organized onto one or more shafts, each rotationally driven by blade motor 208 such as a hydraulic motor. Each organization of cutting blades 204, shaft and blade motor 208 may be organized into a linear configuration and connected to a support shaft 206 through one or more blade motor pivot mounts 212 and one or more blade shaft mounts 214. Each cutting blade 204 and blade motor 208 assemblage may be configured to rotate about the corresponding support shaft 206 upon the corresponding blade motor pivot mounts 212 and blade shaft mounts 214, actuated by one or more blade extension actuators 210. The blade extension actuators 210 may be hydraulic or electric actuators, or any other mechanism capable extending and retracting each corresponding assemblage to engage a water-well casing.

In at least one embodiment, one or more cutting blade 204 and blade motor 208 assemblages, when retracted, are contained within a space defined one or more casing diameter plates 202 configured to allow insertion of the apparatus into a water-well casing. The apparatus may include a rotational element 200 to rotate the apparatus within a water-well casing to allow the cutting blades to cut multiple openings in the water-well casing at certain desirable depths.

A person skilled in the art may appreciate that while the cutting blade 204 and blade motor 208 assemblages are shown in a vertical orientation, such assemblages may also be operable in a horizontal orientation whereby the support shafts 206 are rotated ninety degrees and each corresponding element is adjusted accordingly. Furthermore, a person skilled in the art may appreciate that cutting blade 204 and blade motor 208 assemblages may be offset from each other such that the cutting blades 204 from a first assemblage may nest between the cutting blades 204 of a second assemblage when the assemblages are retraced, thereby allowing for larger cutting blades 204.

While circular cutting blades 204 are shown, it is anticipated that a chainsaw type cutting apparatus may be used to cut openings into the water-well casing. In such an embodiment, elongated chainsaw type cutting blades may be actuated about a support shaft 206 or other structure to temporarily engage the water-well casing.

Figure 3:
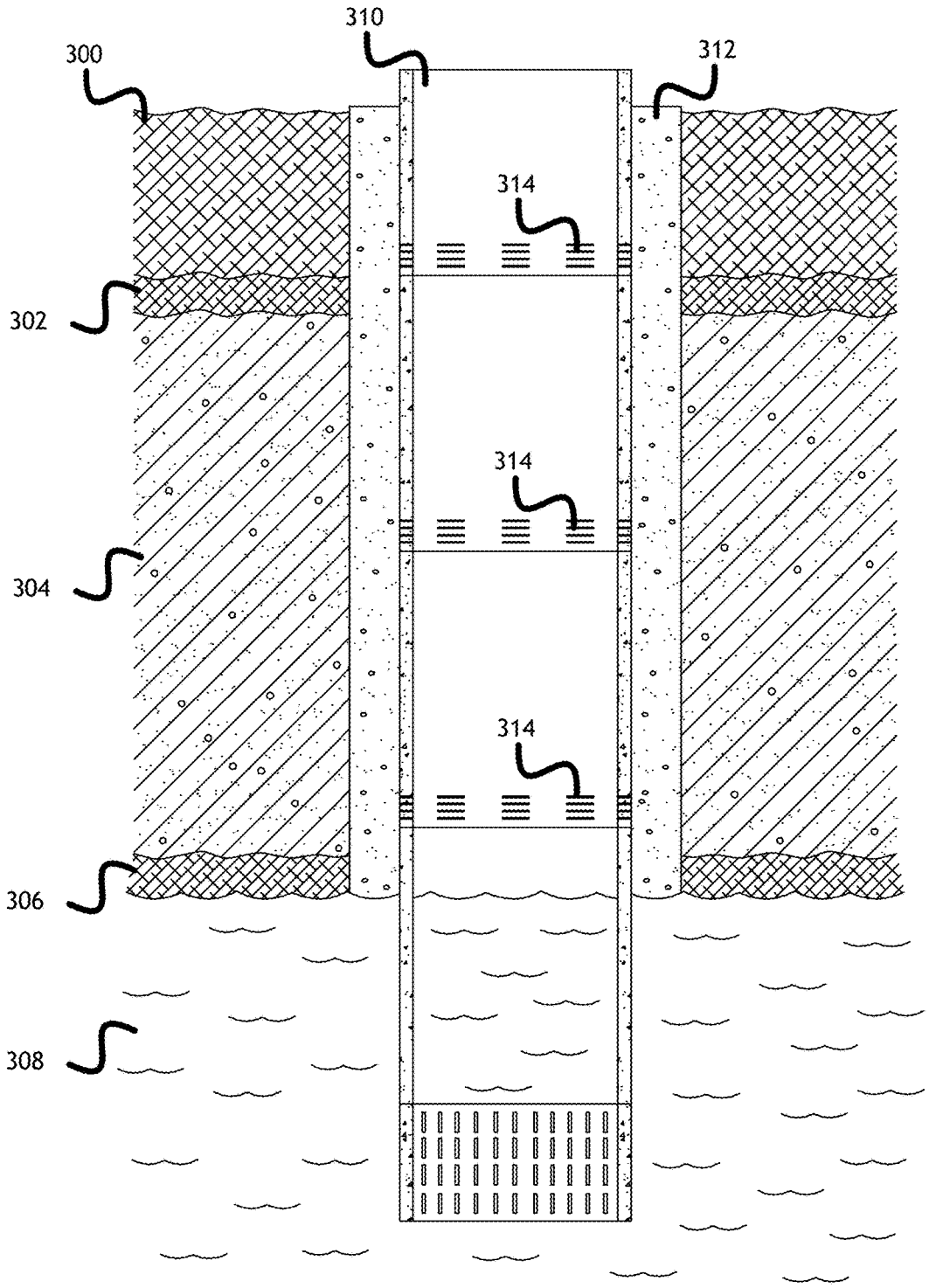
FIG. 3 shows a cross-sectional environmental view of a water well after an embodiment of the present invention has been utilized.

Referring to FIG. 3, a cross-sectional environmental view of a water well after an embodiment of the present invention has been utilized is shown. Where the ground is composed of a plurality of distinct layers such as a topsoil layer 300, a semi-confining layer 302, a sub-soil layer 304 and a confining layer 306, and surface water can penetrate the topsoil layer 300, the semi-confining layer 302 and the sub-soil layer 304, but cannot penetrate the confining layer 306, an apparatus according to the present invention may be lowered into the open casing 310 and lowered to the known depth of the confining layer 306. One or more blade extension actuators then extend a retracted cutting blade assemblage with one or more rotating cutting blades to cut one or more sealant openings 314 into the casing from the inside. At the known depth of the confining layer 306, or some predetermined distance above such depth, the apparatus may be rotated within the casing 310 and the cutting blades extended several times such that one set of cutting blades may be used to produce more than one set of sealant openings 314 at such depth. Sealant openings 314 may be cut above the depth of the confining layer 306 to account for gravity.

In another embodiment of the present invention, an apparatus according to the present invention may be lowered into the open casing 310 and periodically lowered to a known depth corresponding to each joint in the casing 310, or just above each joint in the casing 310. One or more blade extension actuators then extend a retracted cutting blade assemblage with one or more rotating cutting blades to cut one or more sealant openings 314 into the casing from the inside. At each joint, the apparatus may be rotated within the casing 310 and the cutting blades extended several times such that one set of cutting blades may be used to produce more than one set of sealant openings 314. Sealant openings 314 may be cut above the depth of joint in the casing 310 to account for gravity.

Figure 4:
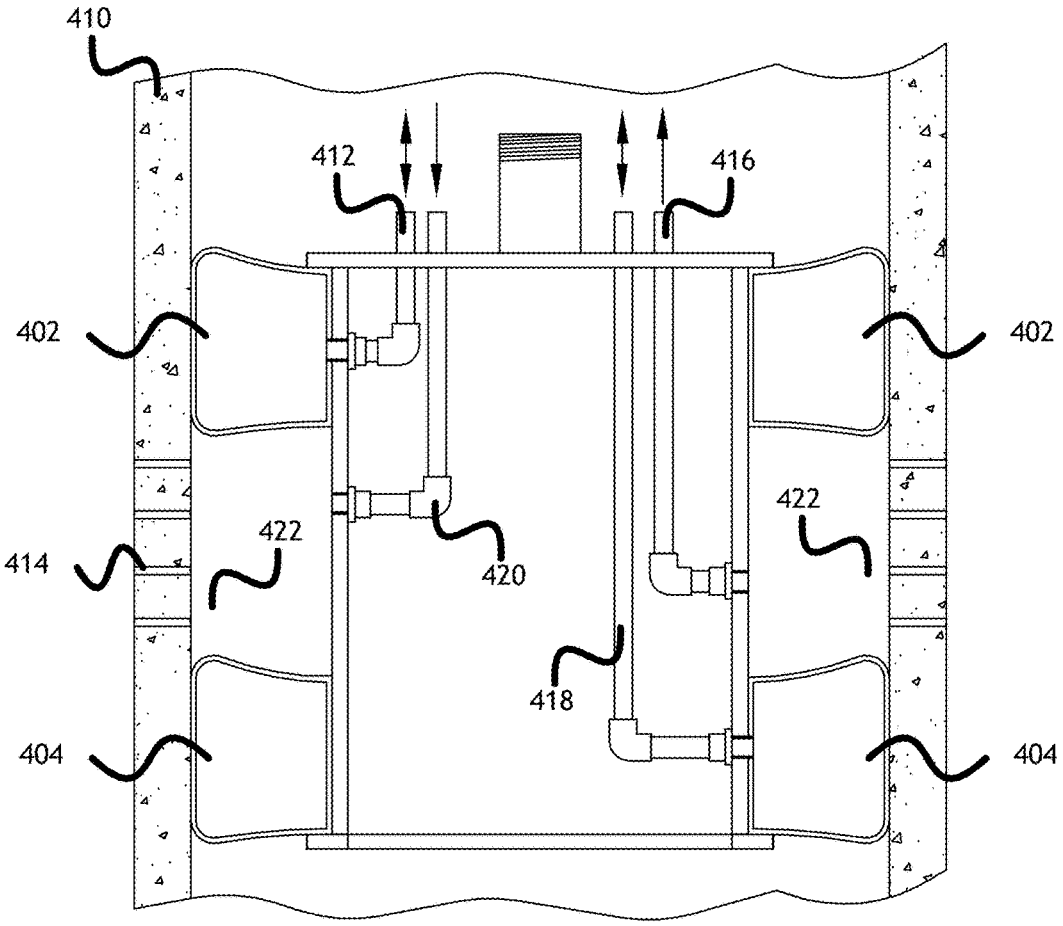
FIG. 4 shows a cross-sectional side view of one embodiment of the present invention.

Referring to FIG. 4, a cross-sectional side view of one embodiment of the present invention is shown. In one embodiment of the present invention, an apparatus for producing a contained, directed flow of sealant within a casing 410 includes an upper inflatable containment element 402 and a lower inflatable containment element 404. The apparatus may be lowered into a casing 410 such that the upper inflatable containment element 402 is positioned above a set of sealant openings 414 and the lower inflatable containment element 404 is positioned below the set of sealant openings 414. A fluid is pumped into the upper inflatable containment element 402 through an upper inflatable element delivery mechanism 412 and a fluid is pumped into the lower inflatable containment element 404 through a lower inflatable element delivery mechanism 418. The upper inflatable containment element 402 and lower inflatable containment element 404 form a fluid tight seal with the casing 410 and define a sealant fluid injection chamber 422 with access to the sealant openings 414. A water impermeable sealant is pumped into the sealant fluid injection chamber 422 and through the sealant openings 414. Sealant may flow through the sealant openings 414 into the aggregate material surrounding the casing 410 to form a water impermeable layer in the aggregate. Sealant may be delivered to the sealant fluid injection chamber 422 through one or more sealant circulation mechanisms 416, 420. A person skilled in the art may appreciate the advantages of a first sealant fluid circulation mechanism 420 devoted to delivering sealant fluid to the sealant fluid injection chamber 422 and a second sealant fluid circulation mechanism 416 devoted to returning circulating sealant fluid.

In at least one embodiment, the sealant used may become progressively more solid over time according to a known algorithm associated with the particular sealant. After the sealant has been delivered, and after a period of time sufficient to allow the sealant to become semi-rigid, the upper inflatable containment element 402 and the lower inflatable containment element 404 may be depressurized and the apparatus raised out of the casing 410, thereby shearing any connection between sealant in the sealant fluid injection chamber 422 and in the sealant openings 414. When the sealant is fully cured, the sealant openings 414 may be sealed and a water impermeable layer formed where the sealant was forced through the aggregate surrounding the casing 410.

In at least one embodiment, sealant fluid openings 414 are cut into a casing 410 at a depth corresponding to a confining soil layer to produce a water well where no contaminant may flow into the potable water bearing layer through spaces around the casing 410. In at least one other embodiment, sealant fluid openings 414 are cut into a casing 410 at each joint in the casing 410 to seal such joints form the outside and thereby prevent contaminants from seeping through such joints over time.

Figure 5:
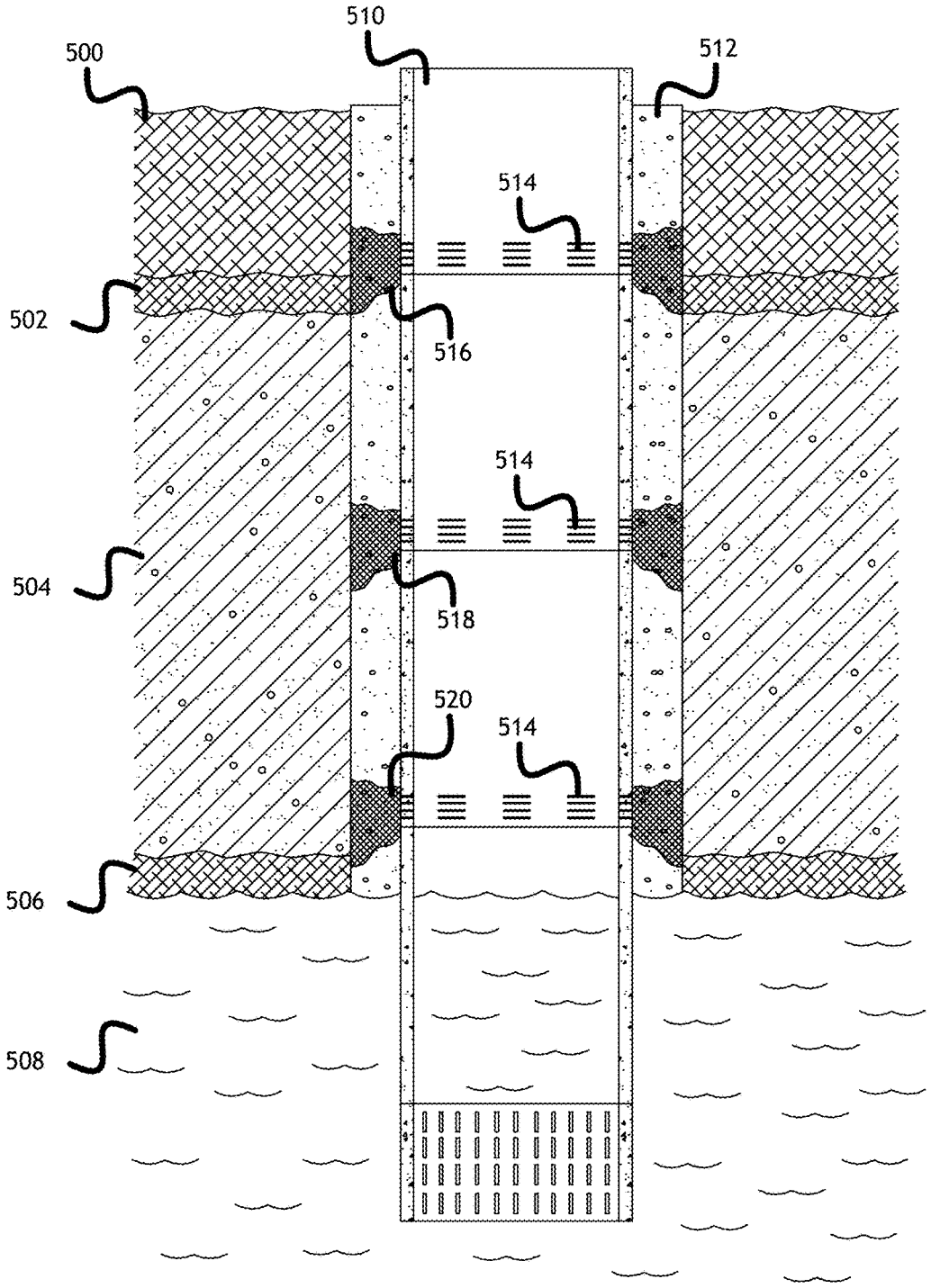
FIG. 5 shows a cross-sectional environmental view of a water well after an embodiment of the present invention has been utilized.

Referring to FIG. 5, a cross-sectional environmental view of a water well after an embodiment of the present invention has been utilized is shown. Where water can penetrate a topsoil layer 500, a semi-confining layer 502 and a sub-soil layer 504, but cannot penetrate the confining layer 506, an apparatus according to the present invention may be lowered into the open casing 510 and at each joint of the casing 510 sealant openings 514 may be cut to allow a sealant fluid to be forced in surrounding aggregate and seal the joints from the outside. Furthermore, sealant openings 514 may be cut into the casing 510 at a depth corresponding to the confining layer 506 to create a substantially continuous water impermeable layer, sealing the portion of the confining layer 506 penetrated by the borehole.

Figure 6:
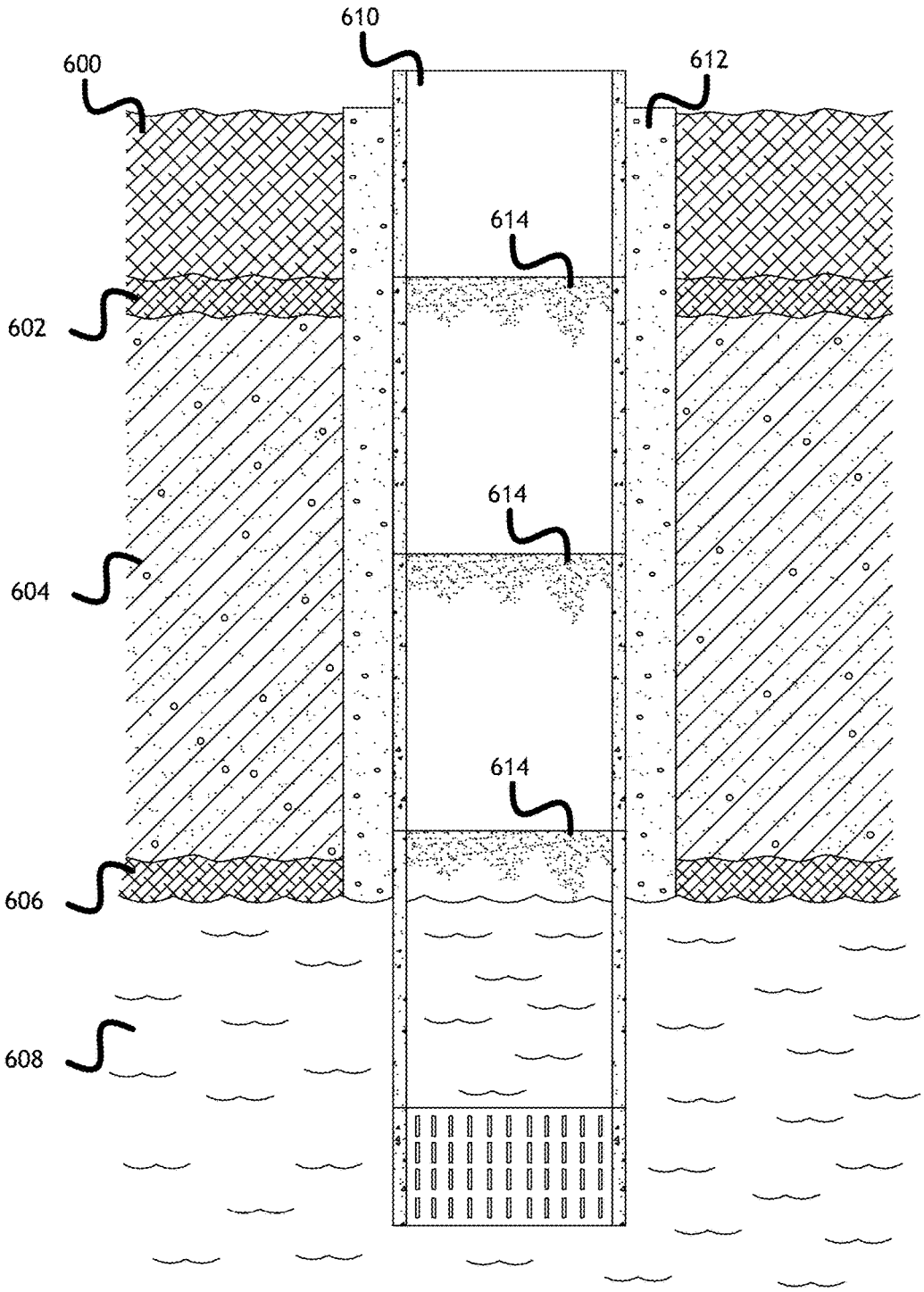
FIG. 6 shows a cross-sectional environmental view of a water well.

Referring to FIG. 6, a cross-sectional environmental view of a water well is shown. In a water well where a casing 610 has penetrated a topsoil layer 600, a semi-confining layer 602, a sub-soil layer 604 and a confining layer 606, scale 614 or other mineralization may seep through each joint of the casing 610 to partially occlude the casing 610.

Figure 7:
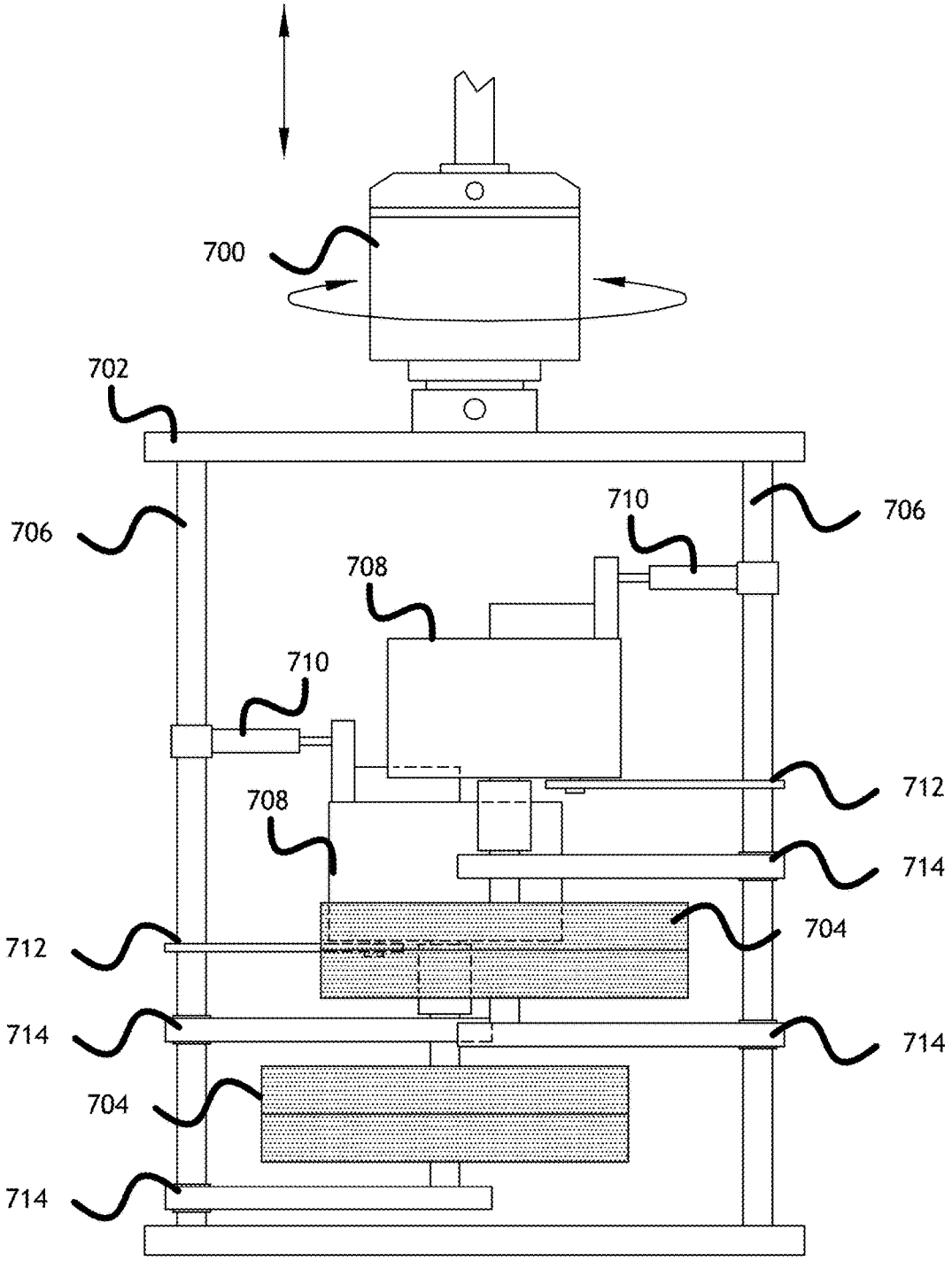
FIG. 7 shows a cross-sectional side view of one embodiment of the present invention.

Referring to FIG. 7, a cross-sectional side view of one embodiment of the present invention is shown. In at least one embodiment, an apparatus includes a plurality of scale brushes 704 configured to grind off or otherwise remove scale buildup from an interior surface of a water-well casing. The plurality of scale brushes 704 may be organized onto one or more shafts, each rotationally driven by scale brush motor 708 such as a hydraulic motor. Each organization of scale brush 704, shaft and scale brush motor 708 may be organized into a linear configuration and connected to a support shaft 706 through one or more scale brush motor pivot mounts 712 and one or more brush shaft mounts 714. Each scale brush 704 and scale brush motor 708 assemblage may be configured to rotate about the corresponding support shaft 706 upon the corresponding scale brush motor pivot mounts 712 and blade shaft mounts 714, actuated by one or more brush extension actuators 710. The brush extension actuators 710 may be hydraulic or electric actuators, or any other mechanism capable extending and retracting each corresponding assemblage to engage a water-well casing.

In at least one embodiment, one or more scale brush 704 and scale brush motor 708 assemblages, when retracted, are contained within a space defined one or more casing diameter plates 702 configured to allow insertion of the apparatus into a water-well casing. The apparatus may include a rotational element 700 to rotate the apparatus within a water-well casing to allow the scale brushes to clean extended portions of the interior of the water-well casing.

A person skilled in the art may appreciate that while the scale brush 704 and scale brush motor 708 assemblages are shown in a vertical orientation, such assemblages may also be operable in a horizontal orientation. Furthermore, a person skilled in the art may appreciate that scale brush 704 and scale brush motor 708 assemblages may be offset from each other such that the scale brushes 704 from a first assemblage may nest between the scale brushes 704 of a second assemblage when the assemblages are retraced, thereby allowing for larger scale brushes 704.

Figure 8:
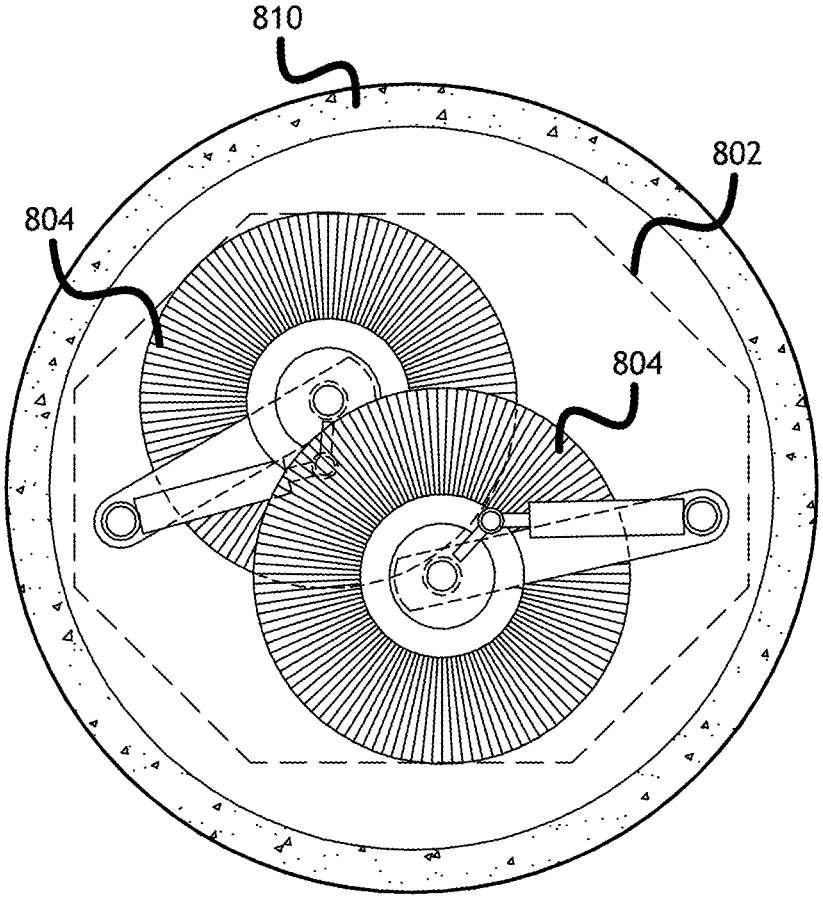
FIG. 8 shows a cross-sectional top view of one embodiment of the present invention.

Referring to FIG. 8, a cross-sectional top view of one embodiment of the present invention is shown. At least one embodiment of the present invention includes one or more casing diameter plates 802 configured to fit within a casing 810. The apparatus includes two or more scale brushes 804 configured to retract within a volume defined by the one or more casing diameter plates 802.

Figure 9:
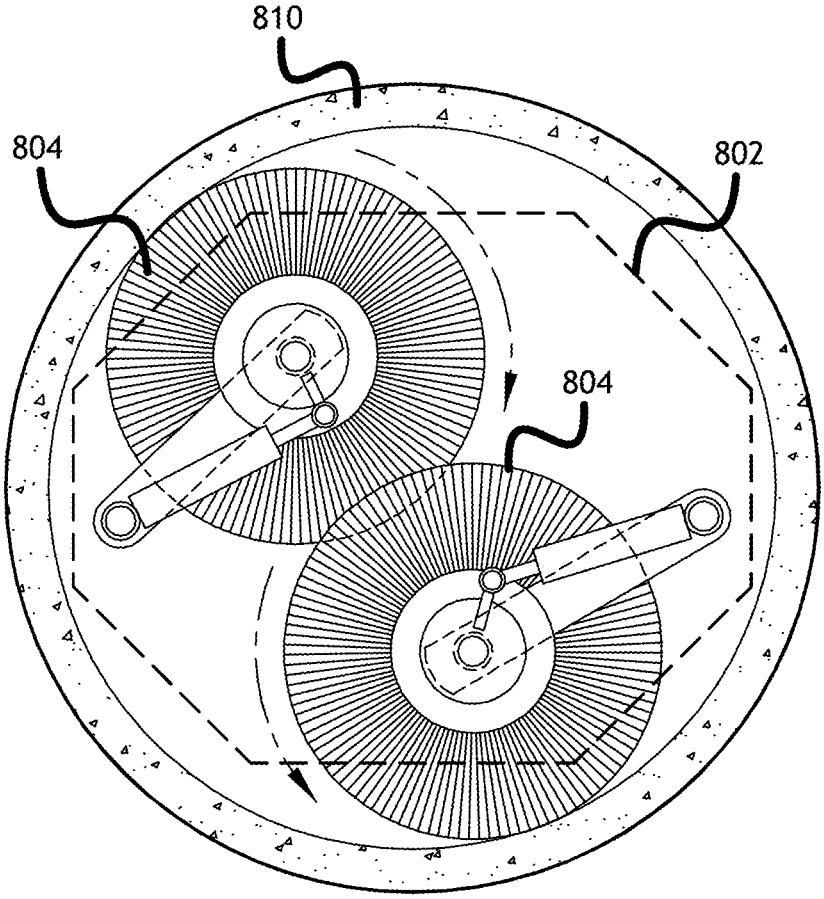
FIG. 9 shows a cross-sectional top view of one embodiment of the present invention.

Referring to FIG. 9, a cross-sectional top view of one embodiment of the present invention is shown. In the embodiment shown in FIG. 8, one or more the two or more scale brushes 804 are extended beyond the volume defined by the one or more casing diameter plates 802 while rotating to remove scale from the interior surface of a water-well casing. Scale brushes 804 may counter-rotate to minimize stress on the apparatus. A person skilled in the art may appreciate that while FIGS. 8 and 9 specifically show scale brushes 804, such representations would be equally applicable to an embodiment having a plurality of cutting blades as described herein.

Figure 10:
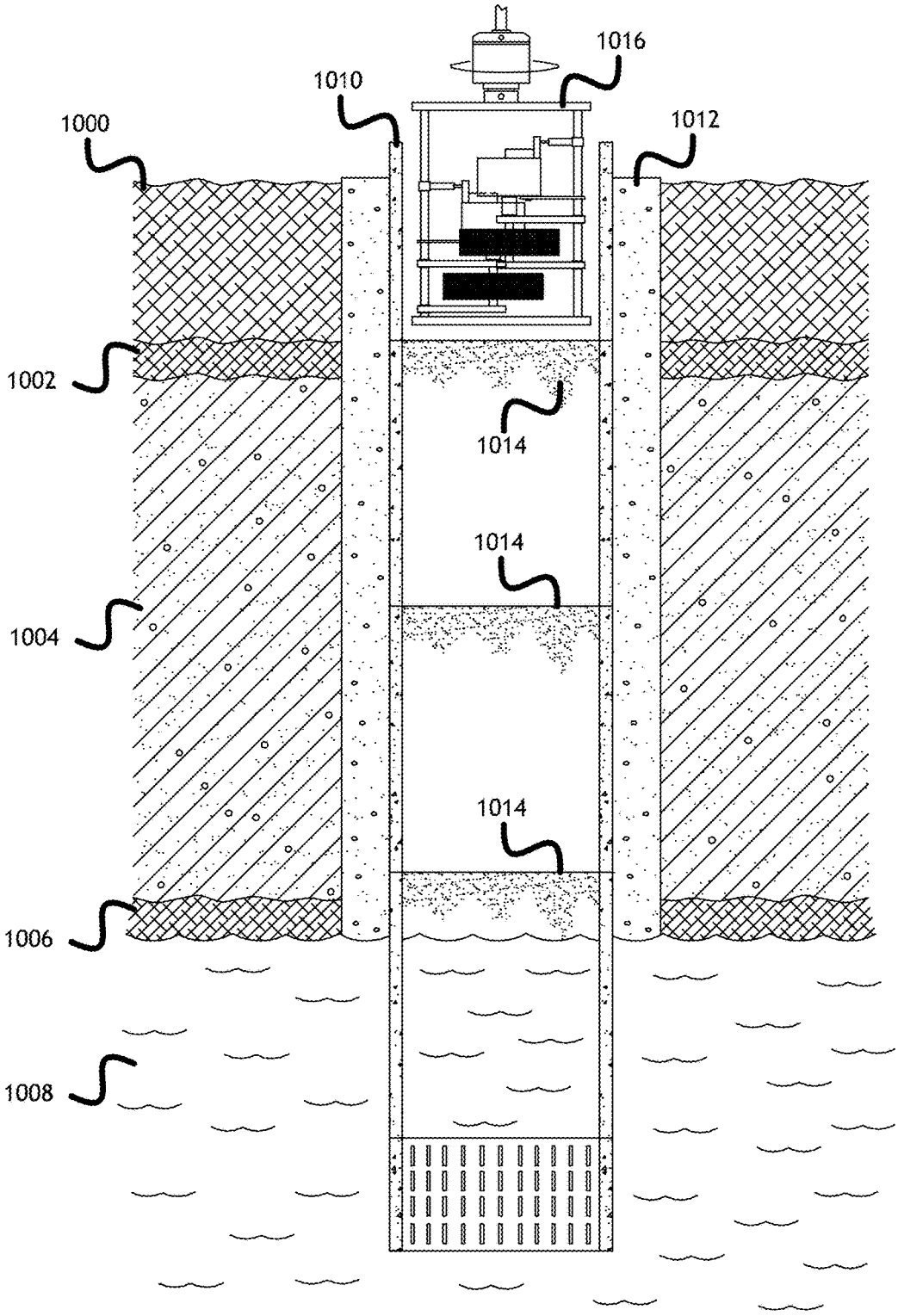
FIG. 10 shows a cross-sectional environmental view of one embodiment of the present invention.

Referring to FIG. 10, a cross-sectional environmental view of one embodiment of the present invention is shown. Where water flowing through a topsoil layer 1000, a semi-confining layer 1002 and a sub-soil layer 1004 can penetrate into joints in a casing 1010 to deposit scale 1014 at such joints, a scale cleaning apparatus 1016 according to the present invention may be lowered into the open casing 1010 and at each joint of the casing 1010 scale 1014 may be removed to prevent occlusion of the casing 1010, and to prepare the casing 1010 for additional remediation.

Figure 11:
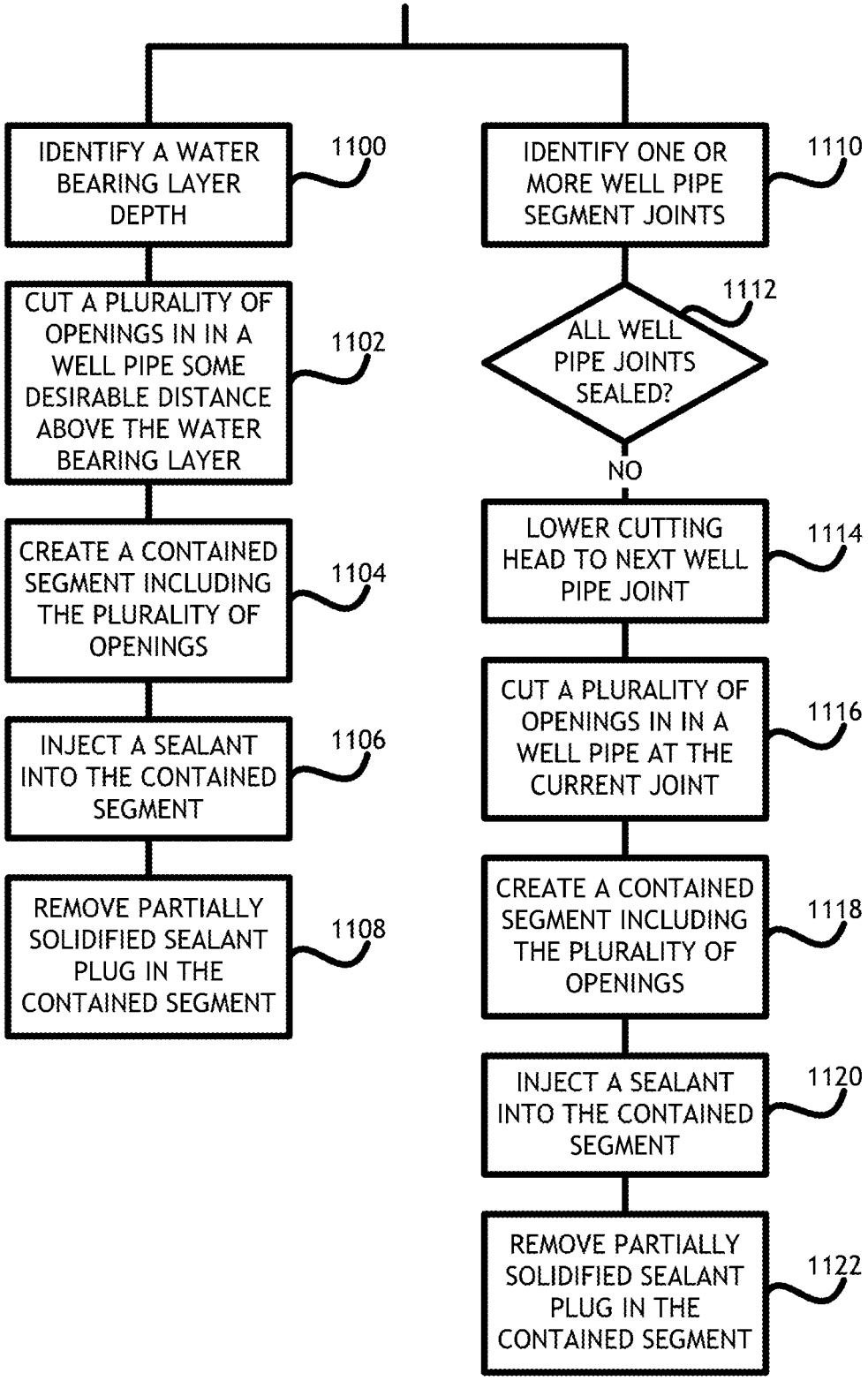
FIG. 11 shows a flowchart of one embodiment of the present invention.

Referring to FIG. 11, a flowchart of one embodiment of the present invention is shown. In at least one embodiment of the present invention, a water-well may be remediated to prevent undesirable chemicals from entering a potable water bearing layer of soil otherwise protected by a water impermeable confining layer. In one embodiment, the depth of the water bearing layer is determined 1100, or alternatively the depth of the confining slayer is determined 1100. An apparatus suitable for cutting sealant openings in the water-well casing cuts 1102 a plurality of sealant openings some distance above the confining layer. A suitable apparatus then creates 1104 a contained, enclosed segment within the casing, including the plurality of sealant openings. A sealant is then injected 1106 into the enclosed segment under sufficient pressure to force the sealant through the sealant openings, into the space surrounding the casing. The sealant may be drawn downward by gravity, so cutting 1102 the sealant openings slightly above the confining layer accounts for the tendency of the sealant to flow downward and thereby engage the confining layer.

The sealant may solidify over time. At some time after sealant injection 1106, the sealant may be solidified enough such that the sealant in the enclosed segment may be removed 1108. In one embodiment, the apparatus for creating 1104 the enclosed segment includes an upper and lower inflatable element to create a seal with the inner surface of the casing. Such inflatable elements may be partially deflated such that the apparatus may be removed from the casing and support any partially solidified sealant between the inflatable elements and the casing.

In another embodiment, each joint in a casing segment may be sealed. One or more well casing segment joints are identified 1110. For each identified segment joint an apparatus is lowered 1114 to a segment joint and a plurality of sealant openings are cut 1116 into the casing. A contained, enclosed segment is created 1118 within the casing, including the plurality of sealant openings. A sealant is then injected 1120 into the enclosed segment under sufficient pressure to force the sealant through the sealant openings, into the space surrounding the casing. At some time after sealant injection 1120, the sealant may be solidified enough such that the sealant in the enclosed segment may be removed 1122. Such process may be repeated until all segment joints are sealed 1112.

A person skilled in the art may appreciate that devices and methodologies according to the present invention may be utilized to remediate water wells or in conjunction with other processes to plug abandoned water wells. Furthermore, a person skilled in the art may appreciate that while processes for remediating water wells is described, other types of wells, or any borehole including a casing of inferior diameter, where contamination seeping from the surface is undesirable may benefit from the devices and methodologies described herein.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A well servicing apparatus comprising:

a first retractable cutting blade assembly comprising:

a first cutting blade shaft;

one or more first cutting blades connected to the first cutting blade shaft;

a first blade driving element connected to the first cutting blade shaft; and a first cutting blade assembly actuator configured to move the one or more first cutting blades to engage an interior surface of a water-well casing;

a second retractable cutting blade assembly comprising:

a second cutting blade shaft;

one or more second cutting blades connected to the second cutting blade shaft;

a second blade driving element connected to the second cutting blade shaft; and a second cutting blade assembly actuator configured to move the one or more second cutting blades to engage an interior surface of a water-well casing, wherein the well servicing apparatus is configured to fit within a water-well casing; and the first retractable cutting blade assembly and second retractable cutting blade assembly are linearly offset such that the first cutting blades nest between the second cutting blades when the first cutting blade assembly actuator and second cutting blade assembly actuator are retracted.

2. The well servicing apparatus of claim 1, further comprising an apparatus rotating mechanism configured to rotate the well servicing apparatus within a water-well casing such that the first retractable cutting blade assembly and second retractable cutting blade assembly are positioned to engage different portions of the interior surface of the water-well casing.

3. The well servicing apparatus of claim 1, wherein the first retractable cutting blade assembly and second retractable cutting blade assembly are configured to counter-rotate.

4. The well servicing apparatus of claim 1, wherein the first cutting blade shaft and the second cutting blade shaft are oriented along an axis substantially parallel to an axis defined by a direction of orientation for lowering the well servicing apparatus into a water-well casing.

5. The well servicing apparatus of claim 1, wherein at least one of the first blade driving element and the second blade driving element is a hydraulic motor.

* * * * *